US007878855B2

(12) United States Patent
Li

(10) Patent No.: US 7,878,855 B2
(45) Date of Patent: Feb. 1, 2011

(54) CABLE CONNECTOR ASSEMBLY WITH A FRONT SHELL

(75) Inventor: Chang-Mao Li, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/761,615

(22) Filed: Apr. 16, 2010

(65) Prior Publication Data

US 2010/0267281 A1 Oct. 21, 2010

(30) Foreign Application Priority Data

Apr. 16, 2009 (CN) ..... 2009 2 0302250

(51) Int. Cl.
*H01R 9/03* (2006.01)

(52) U.S. Cl. ..... 439/607.45; 439/607.04; 439/607.55

(58) Field of Classification Search ..... 439/607.4, 439/607.27, 607.47, 607.45, 607.53, 607.55, 439/607.56, 607.58
See application file for complete search history.

(56) References Cited

U.S. PATENT DOCUMENTS 4,585,292 A * 4/1986 Frantz et al. ..... 439/607.47
4,895,535 A * 1/1990 Emadi et al. ..... 439/681
5,052,949 A * 10/1991 Lopata et al. ..... 439/607.45
5,066,237 A * 11/1991 Shiley ..... 439/82
5,147,220 A * 9/1992 Lybrand ..... 439/567
5,199,903 A * 4/1993 Asick et al. ..... 439/607.47
5,695,366 A * 12/1997 Tomczak et al. ..... 439/607.04
6,017,245 A * 1/2000 Karir ..... 439/607.45
6,146,205 A * 11/2000 Lai ..... 439/607.41
6,165,017 A * 12/2000 Kuo ..... 439/607.45
6,193,555 B1 * 2/2001 Chang ..... 439/607.09
6,210,225 B1 * 4/2001 Cai et al. ..... 439/607.4
6,290,548 B1 * 9/2001 Yeh ..... 439/701
6,663,415 B1 * 12/2003 Wu ..... 439/460
6,669,514 B2 * 12/2003 Wiebking et al. ..... 439/701
6,688,903 B2 * 2/2004 Kakinoki et al. ..... 439/362
6,761,583 B2 * 7/2004 Ortowski et al. ..... 439/540.1
6,786,770 B1 * 9/2004 Huang ..... 439/607.55
7,104,842 B1 * 9/2006 Huang et al. ..... 439/607.55
7,677,927 B2 * 3/2010 Hermant et al. ..... 439/607.46
2002/0025719 A1 * 2/2002 Dingenotto et al. ..... 439/607
2002/0068476 A1 * 6/2002 Kakinoki et al. ..... 439/362
2005/0026501 A1 * 2/2005 Zhan et al. ..... 439/607
2008/0268707 A1 * 10/2008 Wu et al. ..... 439/607
2010/0151732 A1 * 6/2010 Xu et al. ..... 439/607.45

FOREIGN PATENT DOCUMENTS

CN 2390286 Y 8/2000

* cited by examiner

*Primary Examiner*—Briggitte R Hammond
(74) *Attorney, Agent, or Firm*—Wei Te Chung; Andrew C. Cheng; Ming Chieh Chang

(57) ABSTRACT

A cable connector assembly includes an insulative housing (1) having a number of contacts (2) received therein, a shielding member (4) enclosing the insulative housing, a printed circuit board (3) connected with tail portions of the contacts, a cable (5) connected with the printed circuit board, a metallic shell (6) enclosing the printed circuit board and a front shell (7) located in front of the shielding member (4). The front shell is of metallic laminar configuration and comprises a frame-shaped opening (71) in center thereof for the shielding member to be inserted into.

15 Claims, 5 Drawing Sheets

CABLE CONNECTOR ASSEMBLY WITH A FRONT SHELL

BACKGROUND OF THE INVENTION

1. Field of the Invention

The present invention generally relates to a cable connector assembly, and more particularly to a cable connector assembly used for video signal transmission.

2. Description of Related Art

Nowadays, cable connector assemblies are widely used in electronic devices, and the cable connector assembly usually defines a shielding mechanism to reduce the Electro Magnetic Interference (EMI). CN patent No. 2390286Y issued to Lai on Aug. 2, 2000 discloses a cable connector assembly, the cable connector assembly comprises an insulative housing, a plurality of contacts received in the insulative housing, a shielding member enclosing a mating port of the insulative housing, and a cover assembled on the insulative housing, the cable connector assembly also has a shell encircling a rear part of the insulative housing to shielding the electrical connection, the shielding member can shield the mating area of the insulative housing, but engaging gap is occurred between a front part of the shielding member and the shell, therefore the EMI maybe affect the signal transmission.

Correspondingly, it is desired to have a cable connector assembly with improved shielding member to address the problems stated above.

BRIEF SUMMARY OF THE INVENTION

Accordingly, an object of the present invention is to provide a cable connector assembly having an extra front shell reducing Electro Magnetic Interference (EMI) in the signal transmission.

In order to achieve the above-mentioned object, a cable connector assembly in accordance with the present invention comprises an insulative housing having a number of contacts received therein, a shielding member enclosing the insulative housing, a printed circuit board connected with tail portions of the contacts, a cable connected with the printed circuit board, a metallic shell enclosing the printed circuit board and a front shell located in front of the shielding member. The front shell is of metallic laminar configuration and comprises a frame-shaped opening in center thereof for the shielding member to be inserted into.

Other objects, advantages and novel features of the invention will become more apparent from the following detailed description of the present embodiment when taken in conjunction with the accompanying drawings.

DETAILED DESCRIPTION OF THE INVENTION

Figure 1:
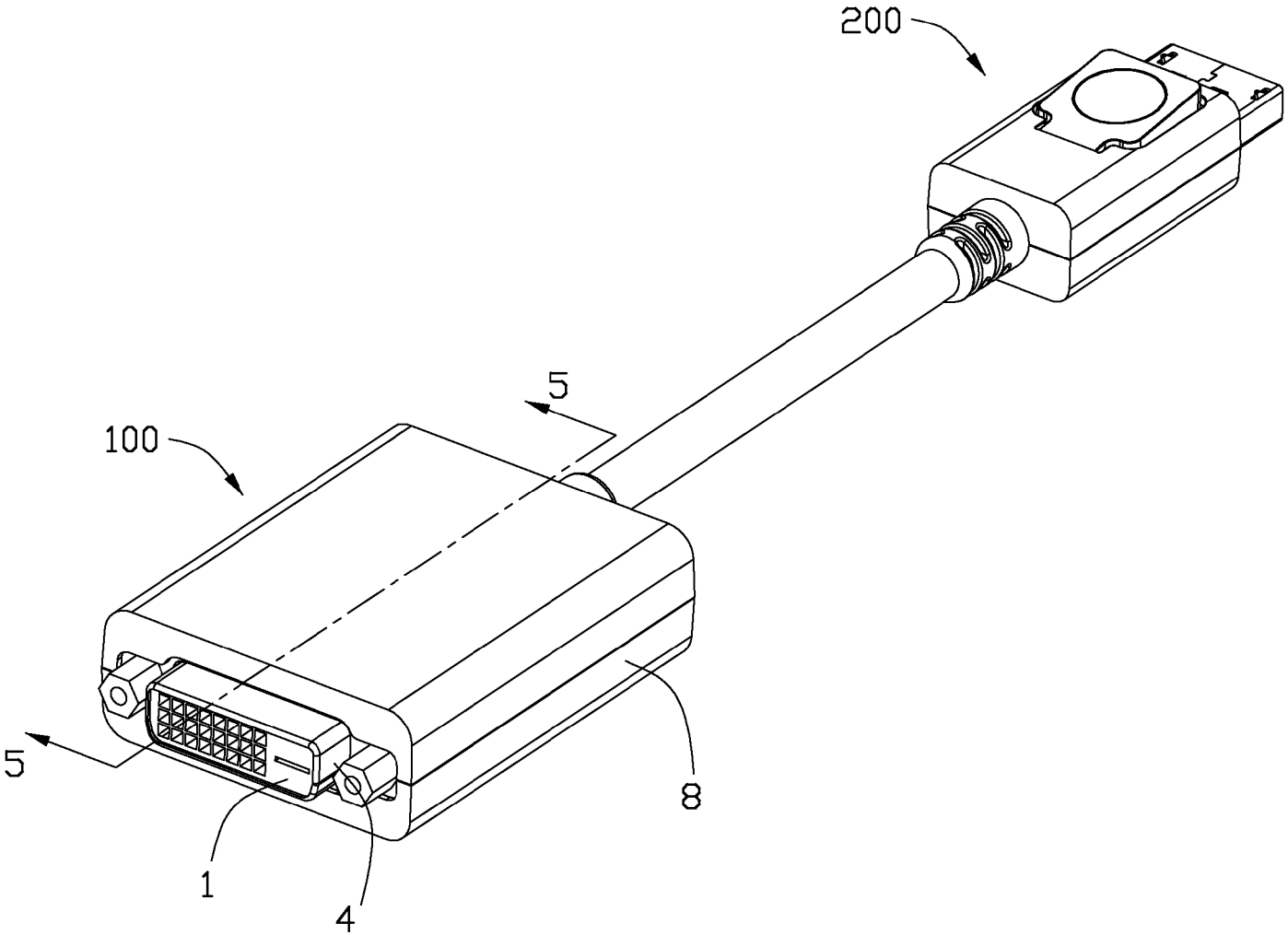
FIG. 1 is an assembled, perspective view of a cable connector assembly of the present invention connected with a Display port connector.

Reference will now be made to the drawing figures to describe the present invention in detail.

Figure 2:
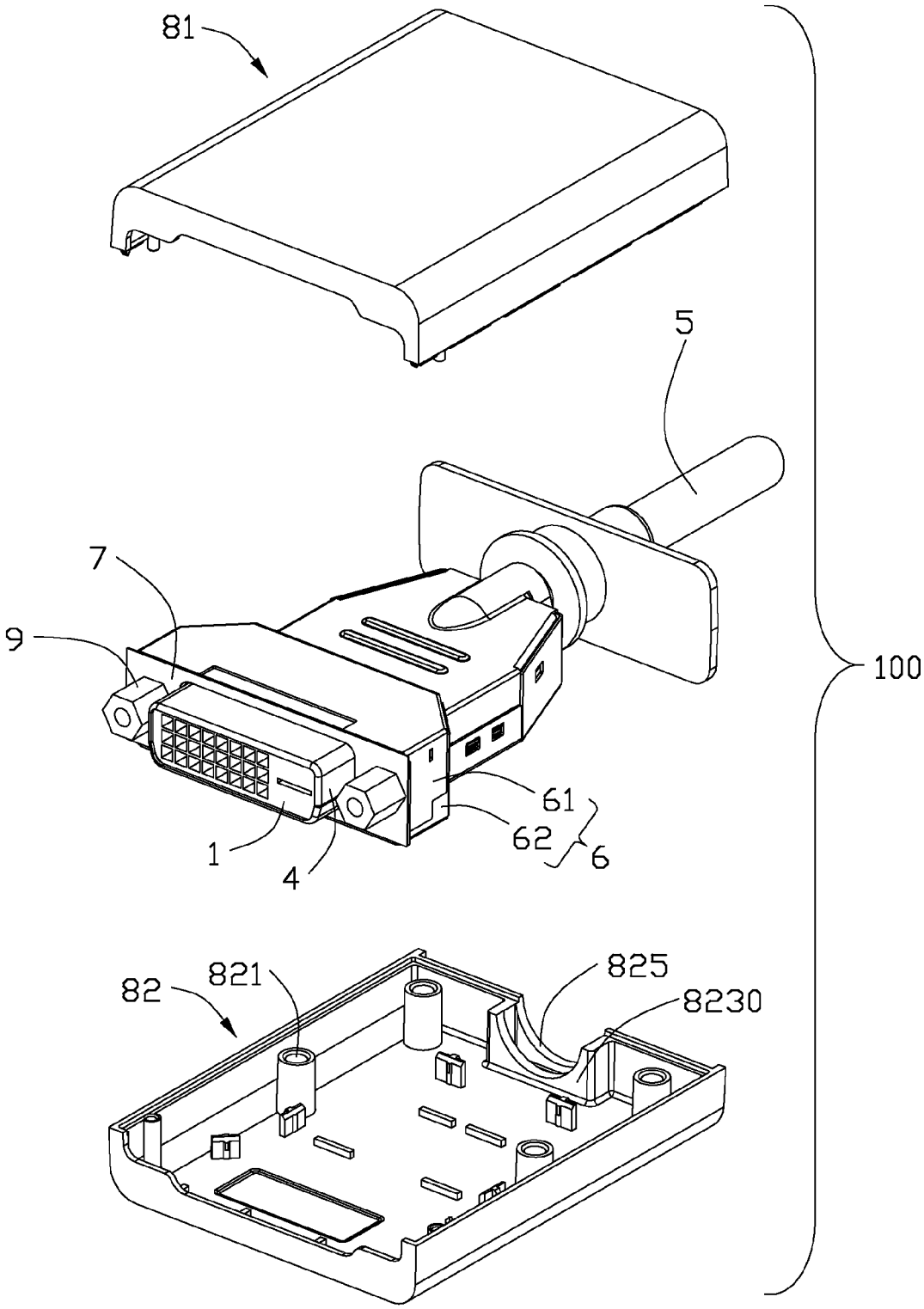
FIG. 2 is a partially exploded, perspective view of the cable connector assembly.
Figure 3:
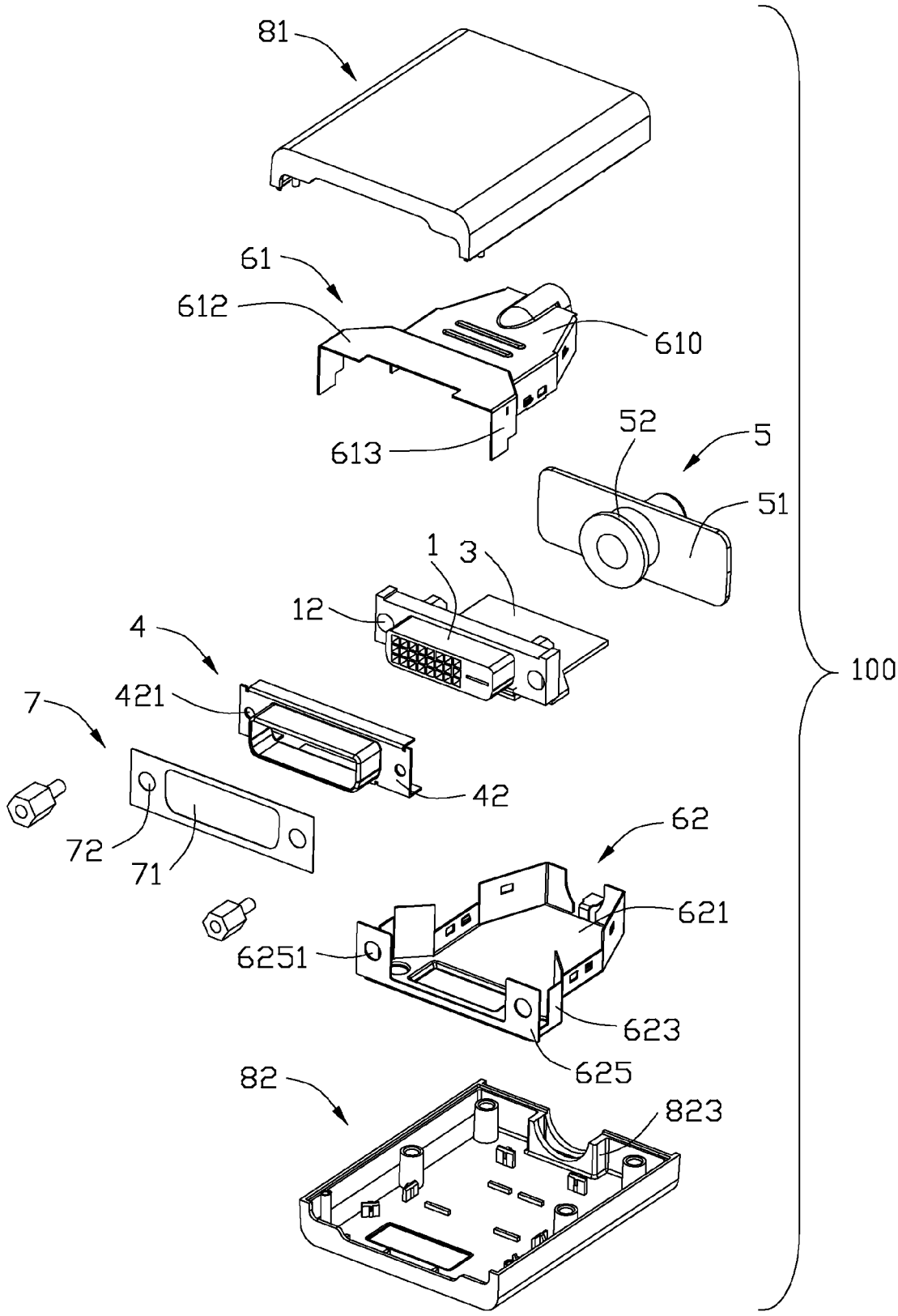
FIG. 3 is another exploded, perspective view of the cable connector assembly shown in FIG. 2.
Figure 4:
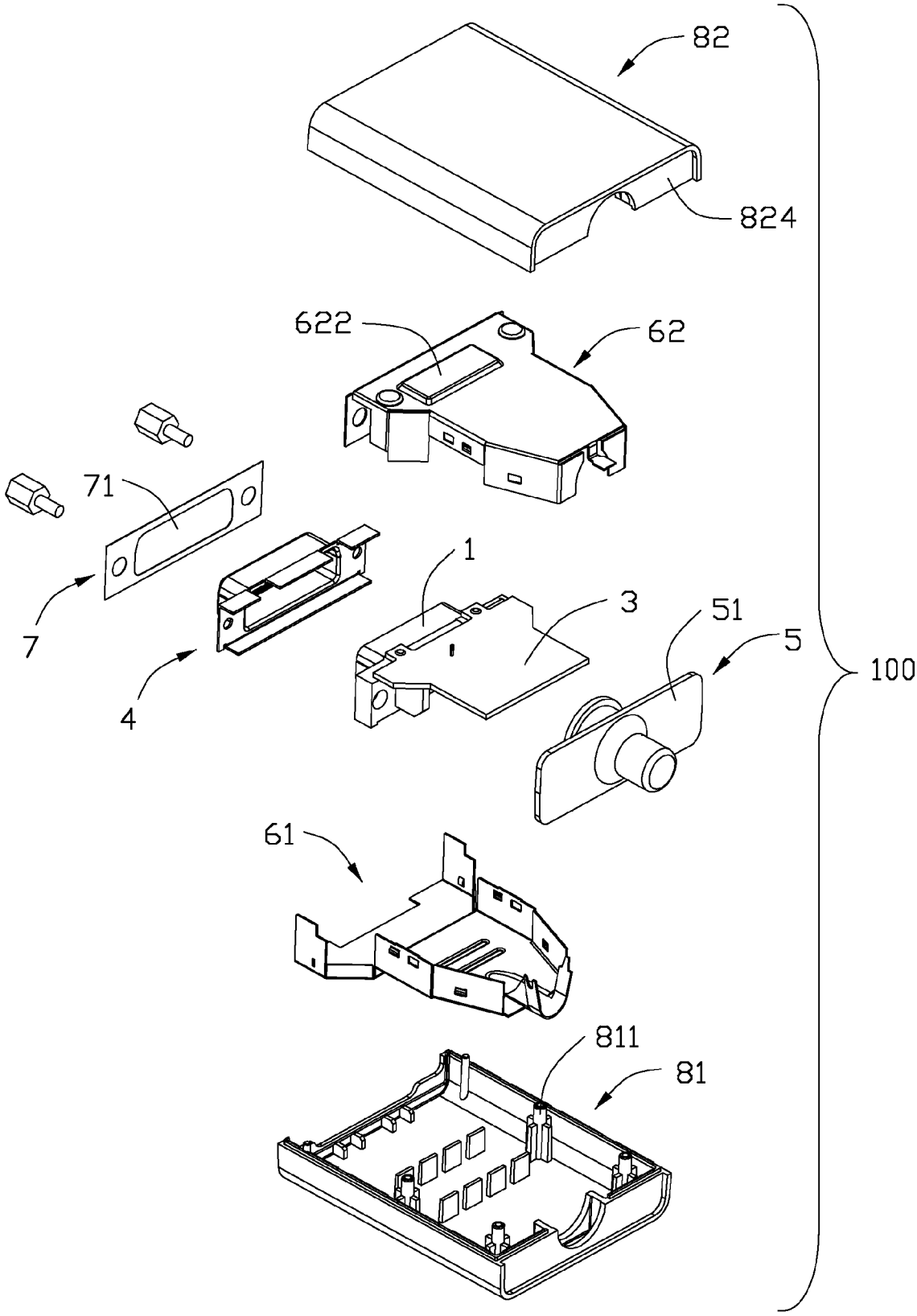
FIG. 4 is similar to FIG. 3, but viewed from another aspect.
Figure 5:
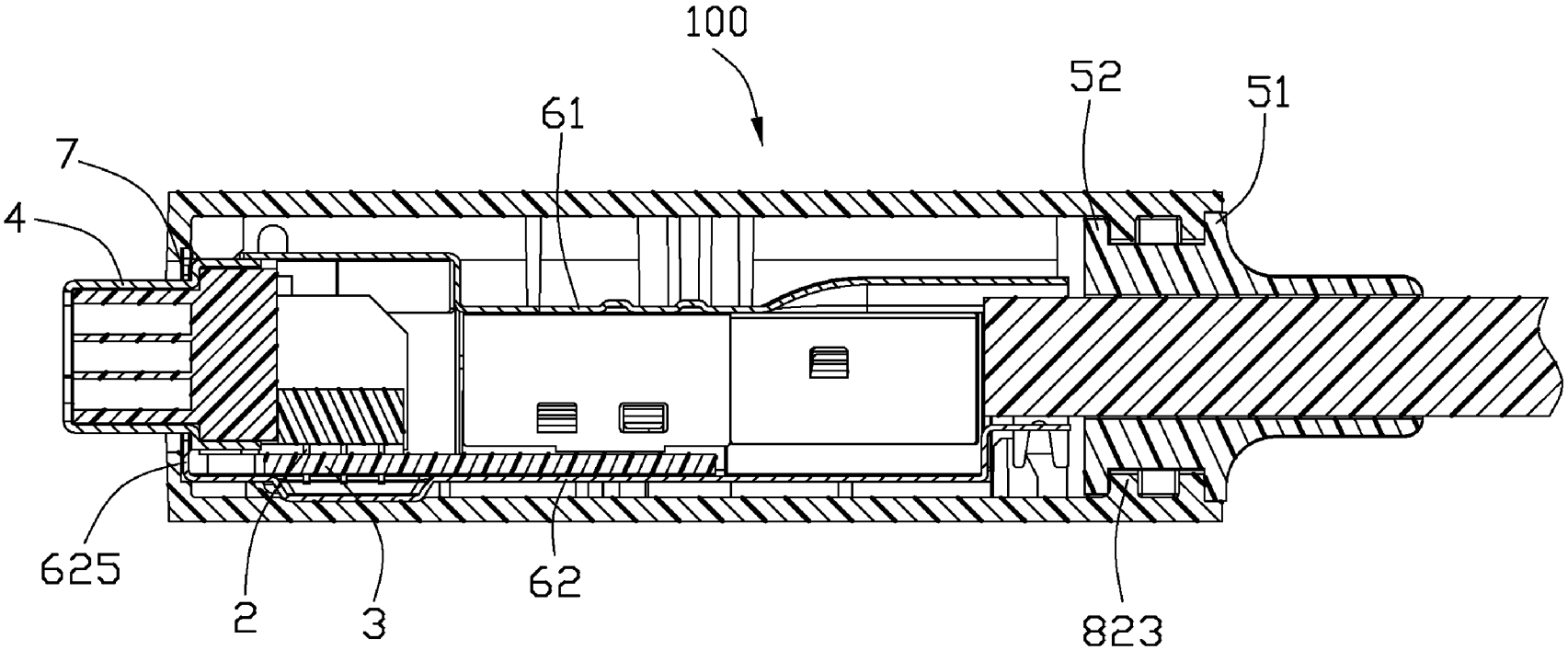
FIG. 5 is a cross-section view taken along line 5-5 of the FIG. 1.

Referring to FIGS. 1-3, a cable connector assembly 100 in accordance with the present invention can be connected with another cable connector assembly 200 compatible with Display Port transmitting protocol to form an adapter. And the cable connector assembly 100 comprises an insulative housing 1, a plurality of contacts 2 received in the insulative housing 1, a printed circuit board 3, a metallic shielding 4 enclosing a mating port of the insulative housing 1, a cable 5, a metallic shell 6 enclosing the printed circuit board 3 and the insulative housing 1, a front shell 7 located in front of the shell 6 and a cover 8 enclosing the aforementioned components. The cover 8 is made of insulative material, and comprises an upper cover 81 and a lower cover 82 assembled to each other along a direction perpendicular to a mating direction.

Referring to FIGS. 2-5, the cable connector assembly 100 is compatible with Digital Visual Interface (DVI) transmitting protocol. The contacts 2 are assembled in the insulative housing 1, and tail portions of the contacts 2 are bent downwards to be inserted in and soldered to the printed circuit board 3.

Referring to FIGS. 1-3, the insulative housing 1 defines a pair of fastening holes 12 at opposite sides thereof, a pair of nuts 9 are mounted in the corresponding fastening holes 12 and coupled to a complementary connector (not shown). The metallic shielding member 4 is enclosing the insulative housing 1 and a mating port of the cable connector assembly 100 to reduce Electro Magnetic Interference (EMI). The shielding member 4 defines a vertical wall 42 with a pair of through holes 421 aligned with corresponding fastening holes 12 along the mating direction.

The cable 5 defines a strain relief portion (not labeled) on a front segment thereof, the strain relief portion has a cylindrical protruding portion 52 on a front end thereof and a rectangular retaining portion 51 behind the protruding portion 52. The retaining portion 51 is spaced apart from the protruding portion 52, and the retaining portion 51 has a larger width than the protruding portion 52 along a transverse direction. The cable 5 also comprises a plurality of wires (not shown). and a rectangular 510 is defined on the retaining portion 51.

The shell 6 is made of metallic material and comprises a top shell 61 and a bottom shell 62 assembled to each other. The top shell 61 comprises a base portion 610 and an extension portion 612 bending upwards firstly and then extending forwards from the base portion 610, the extension portion 612 is wider than the base portion 610 along the transverse direction. The top shell 61 defines a pair of side walls 613 bent downwards.

The bottom shell 62 comprises a lower wall 621 and a pair of lateral walls 623 bent upwards from both sides of the lower wall 621. The lateral walls 623 are engaging with the corresponding side walls 613 of the top shell 61. The lower wall 621 is recessed downwards to form a depression 622, a pair of blocking portions 625 are located on a front end of the lower wall 621 and bent upwards to be perpendicular to the mating direction, and each blocking portion 625 defines a circular matching hole 6251.

The front shell 7 is of metallic laminar configuration, and comprises a frame-shaped opening 71 in center thereof and a pair of positioning holes 72 located on both sides of the frame-shaped opening 71. The frame-shaped opening 71 and a front section of the shielding member 4 have the same shape with each other, and the frame-shaped opening 71 has a little larger size than the front section of the shielding member 4 to make the shielding member 4 be inserted into thereof, and the front shell 7 is adjacent to a front surface of the vertical wall 42 of the shielding member 4.

The upper cover 81 defines a plurality of posts 811 around an inner wall thereof equably, the lower cover 82 defines a plurality of engaging holes 821 cooperating with corresponding posts 811. The upper cover 81 and the lower cover 82 have the same configuration with each other, both of the upper cover 81 and the lower cover 82 define a clipping portion 823 on a rear end thereof with a front end surface 8230 and a receiving groove 824 recessed forwards from the clipping portion 823, and an arc-shaped cutout 825 is recessed downwards from an upper surface of the clipping portion 823 to receive the cable 5.

In assembly, the contacts 2 are received in the insulative housing 1, tail portions of the contacts 2 are soldered to a front area of the printed circuit board 3, the shielding member 4 is enclosing the insulative housing 1. The wires of the cable 5 are soldered to a back area of the printed circuit board 3. The aforementioned elements are assembled into the bottom shell 62, the blocking portions 625 are adjacent to a front surface of the shielding member 4, segments of the contacts 2 inserted through the printed circuit board 3 are located above the depression 622 of the bottom shell 62. The front shell 7 is assembled to a front side of the blocking portions 625 of the bottom shell 62 along a front-to-back direction, the shielding member 4 is enclosed in the frame-shaped opening 71, and the front shell 7 is adjacent to the blocking portions 625 to reduce EMI in small dimension. In addition, the front shell 7, the blocking portions 625 and the vertical wall 42 of the shielding member 4 are arranged along the front-to-back direction in sequence, simultaneously, the positioning holes 72 of the front shell 7, the matching holes 6251 of the bottom shell 62, the through holes 421 of the shielding member 4 and the fastening holes 12 of the insulative housing 1 are aligning with each other along the mating direction, so as to the nuts 9 insert into the corresponding positioning holes 72, the matching holes 6251, the through holes 421 and the fastening holes 12 successfully, and to realize the mechanical connection between the front shell 7, the bottom shell 62 and the shielding member 4.

Then the top shell 61 is assembled to the bottom shell 62 along an up-to-down direction, the side walls 613 of the top shell 61 are engaging with the lateral walls 623 of the bottom shell 62 to combine the top shell 61 and the bottom shell 62. The extension portion 612 of the top shell 62 is shielding a rear section of the insulative housing 1, and the base portion 610 is located above the printed circuit board 4. Therefore, the shell 6 is enclosing the shielding member 4, the insulative housing 1 and the electrical connection area to reduce EMI.

Then the cover 8 is assembled to the aforementioned elements, the retaining portion 51 of the cable 5 is disposed in the receiving groove 824 of the lower cover 82 to prevent the cable 5 moving forth, the cylindrical protruding portion 52 of the cable 5 is located in front of the clipping portion 823 and adjacent to the front end surface 8230 of the clipping portion 823, and then the upper cover 81 is assembled to the lower cover 82 along the up-to-down direction, the posts 811 of the upper cover 81 are inserted into the corresponding engaging holes 821 of the lower cover 82, and the clipping portions 823 of the upper cover 81 and the lower cover 82 are cooperated with each other to retain the cable 5. Thus, the cable connector assembly 100 is assembled.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

an insulative housing and a plurality of contacts received therein;

a shielding member enclosing the insulative housing;

a printed circuit board connected with tail portions of the contacts;

a cable connected with the printed circuit board;

a metallic shell enclosing the printed circuit board; and a front shell located in front of the shielding member, the front shell being of metallic laminar configuration and comprising a frame-shaped opening in center thereof for the shielding member to be inserted into.

2. The cable connector assembly as claimed in claim 1, wherein the metallic shell defines a pair of blocking portions bent from a front end thereof, each blocking portion having a circular matching hole, and the front shell comprises a pair of positioning holes on both sides thereof aligning with corresponding matching holes.

3. The cable connector assembly as claimed in claim 2, wherein the front shell is adjacent to a front end surface of the blocking portions.

4. The cable connector assembly as claimed in claim 2, wherein the shielding member defines a pair of through holes aligned with corresponding matching holes, and the insulative housing has a pair of fastening holes aligning with corresponding through holes.

5. The cable connector assembly as claimed in claim 4, wherein the metallic shell has a top shell and a bottom shell assembled to each other, and the blocking portions are arranged on one of the top shell and the bottom shell.

6. The cable connector assembly as claimed in claim 5, wherein the bottom shell comprises a lower wall and a pair of lateral walls bent upwards from both sides of the lower wall, and the lower wall defines a depression recessed downwards.

7. The cable connector assembly as claimed in claim 6, wherein the contacts are protruding through and soldered on the printed circuit board, and located above the depression of the bottom shell.

8. The cable connector assembly as claimed in claim 4, wherein the top shell comprises a base portion and an extension portion extending forwards from the base portion.

9. The cable connector assembly as claimed in claim 8, wherein the extension portion of the top shell is shielding a rear segment of the insulative housing, and the base portion is located above the printed circuit board.

10. The cable connector assembly as claimed in claim 1, wherein the cable has a cylindrical protruding portion on a front end thereof and a rectangular retaining portion behind the protruding portion, and the retaining portion is spaced apart from the protruding portion.

11. The cable connector assembly as claimed in claim 10, further comprising a cover, and wherein the cover defines a clipping portion supporting the cable.

12. The cable connector assembly as claimed in claim 11, wherein a receiving groove is recessed forwards from the clipping portion and accommodates the retaining portion of the cable, and the protruding portion is located in front of the clipping portion.

13. An electrical cable connector assembly comprising:

an insulative housing defining a front mating section extending forwardly from a front face of a rear retention section;

a plurality of contacts disposed in the housing;

a metallic shielding member attached to the housing and defining a rear plate covering the front face of the rear section and a front frame section enclosing the front mating section;

a metallic cover shell including a main cover shell defining a pair of blocking portions each with a first through hole extending therethrough in a front-to-back direction, said pair of blocking portions commonly defining an opening therebetween in a transverse direction perpendicular to said front-to-back direction, said opening being open in one vertical side so as to allow the housing and the associated shell to be assembled to the main shell in a vertical direction perpendicular to both said front-to-back direction and said transverse direction with the mating section of the housing and the frame section of the shielding member extending through the opening and forwardly away from the blocking portions under condition that the rear plate of the shielding member forwardly abuts directly and intimately against back faces of the pair of blocking portions; and a planar metallic front shell directly and intimately attached on front faces of the pair of blocking portions; wherein said front shell is of a full frame structure defining an opening snugly circumferentially receiving the frame section of the shielding member and the associated mating section of the housing therein.

14. The electrical cable connector assembly as claimed in claim 13, wherein the front shell defines a pair of second through holes and the rear plate of the shielding member defines a pair of third through holes, respectively aligned with the corresponding pair of first through holes in the front-to-back direction.

15. The electrical cable connector assembly as claimed in claim 14, wherein the rear section of the housing defines a pair of fourth through holes, respectively aligned with the corresponding pair of first, second and third through holes so as to have a pair of screws extend therethough, respectively.

* * * * *